US005997337A

United States Patent [19]

Torii

[11] Patent Number: 5,997,337

[45] Date of Patent: Dec. 7, 1999

[54] ELECTRIC-WIRE CONNECTING STRUCTURE

[75] Inventor: Chieko Torii, Shizuoka, Japan

[73] Assignee: Yazaki Corporation, Tokyo, Japan

[21] Appl. No.: 09/099,424

[22] Filed: Jun. 18, 1998

[30] Foreign Application Priority Data

Jun. 20, 1997 [JP] Japan ..... 9-164283

[51] Int. Cl.[6] ..... H01R 4/24

[52] U.S. Cl. ..... 439/399; 439/942

[58] Field of Search ..... 439/404, 397, 439/399, 407, 417

[56] References Cited

U.S. PATENT DOCUMENTS 4,494,813 1/1985 Daley, Jr. et al. ..... 439/404
5,073,126 12/1991 Kikuchi et al. ..... 439/397
5,514,006 5/1996 Getselis et al. ..... 439/417

*Primary Examiner*—Michael L. Gellner
*Assistant Examiner*—Antoine Ngandjui
*Attorney, Agent, or Firm*—Sughrue, Mion, Zinn, Macpeak & Seas, PLLC

[57] ABSTRACT

An electric-wire connecting structure for press-connecting an electric wire to press-connecting blades of a press-connecting terminal. In such a structure, the electric wire press-connected to the press-connecting blades of the press-connecting terminal is bent toward a fitting mount such as a connector housing with the press-connecting blades as boundaries. The fitting mount fitted with the press-connecting terminal is provided with electric-wire holding members for holding the bent electric wire, whereby a conductor of the electric wire is kept in contact with the press-connecting blades of the press-connecting terminal while tension is being applied to the press-connecting blades.

4 Claims, 4 Drawing Sheets

ELECTRIC-WIRE CONNECTING STRUCTURE

BACKGROUND OF THE INVENTION

1. Field of the Invention

The present invention relates to an electric-wire connecting structure fit for use when an electric wire is press-connected to press-connecting blades of a press-connecting terminal.

2. Description of the Related Art

FIGS. 5(*a*) and 5(*b*) show a known electric-wire connecting structure. As shown in FIG. 5(*a*), a press-connecting terminal 1 to which a covered electric wire 30 is press-connected is U-shaped in side view and has slot-like press-connecting blades 2 on both sides thereof. The covered electric wire 30 is, as shown in FIGS. 5(*a*) and 5(*b*), press-connected by a press-connecting jig 40 to each of the press-connecting blades 2 of the press-connecting terminal 1. More specifically, the press-connecting jig 40 is, as shown in FIG. 5(*a*), used to press-fit an insulating cover 32 of the covered electric wire 30 in between the press-connecting blades 2, 2 of the press-connecting terminal 1. When the insulating cover 32 of the covered electric wire 30 is ripped off by each press-connecting blade 2, a conductor 31 of the covered electric wire 30 is press-connected to each press-connecting blade 2, so that the press-connecting terminal 1 and the covered electric wire 30 are electrically connected together.

In the above conventional electric-wire connecting structure, however, since the insulating cover 32 of the covered electric wire 30 is press-fitted in between the press-connecting blades 2, 2 of the press-connecting terminal 1 for making use of the press-fitting force to hold the electrical connection of the press-connecting blades 2 with the conductor 31 of the covered electric wire 30, the press-fitted condition of the press-connecting blades 2 of the press-connecting terminal 1 and the covered electric wire 30 may be loosened when an external load such as vibration is applied to the press-connecting terminal 1. Consequently, it is feared that the contact condition of the press-connecting blades 2 and the conductor 31 of the covered electric wire 30 is deteriorated.

SUMMARY OF THE INVENTION

An object of the present invention intended to solve the foregoing problems is to provide an electric-wire connecting structure capable of improving the reliability of the press-connected condition of an electric wire and the press-connecting blades of a press-connecting terminal.

In order to achieve the above object, the present invention provides an electric-wire connecting structure comprising: a press-connecting terminal having press-connecting blades; and an electric wire to be press-connected to the press-connecting blades of the press-connecting terminal, wherein the electric wire press-connected to the press-connecting blades of the press-connecting terminal is bent in an electric-wire press-connecting direction with the press-connecting blades as boundaries.

BRIEF DESCRIPTION OF THE DRAWINGS

FIG. 1(*b*) is a partial perspective view of the bent-down condition of the electric wire and the press-connecting blade of a press-connecting terminal as a boundary;

FIG. 2(*b*) is a sectional view of the principal part of the electric-wire connecting structure;

FIG. 5(*b*) is a perspective view of the press-connected condition of the electric wire.

DETAILED DESCRIPTION OF THE PREFERRED EMBODIMENTS

A description will subsequently be given of an embodiment of the present invention with reference to the drawings.

Figure 1A:
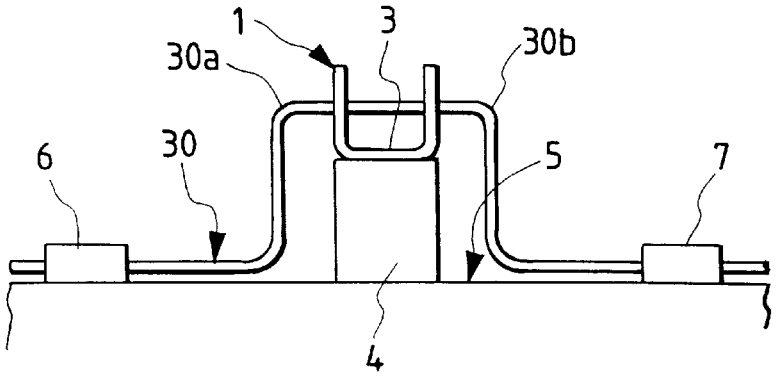
FIG. 1(*a*) is a view illustrating the press-connected condition of an electric wire to which an electric-wire connecting structure according to an embodiment of the invention is applied.
Figure 1B:
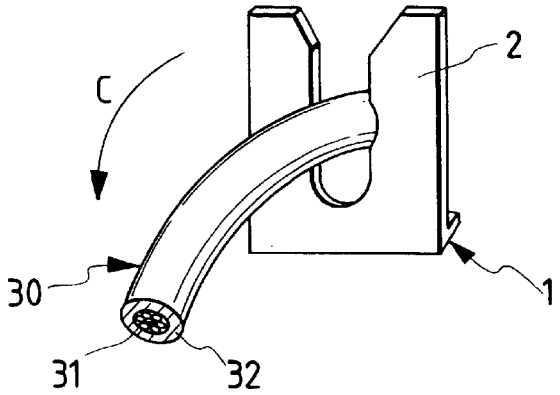

FIG. 1(*a*) is a view illustrating the press-connected condition of an electric wire to which an electric-wire connecting structure according to an embodiment of the invention is applied; FIG. 1(*b*) is a partial perspective view of the bent-down condition of the electric wire and the press-connecting blade of a press-connecting terminal as a boundary; and FIG. 4 is a graph showing comparative measured values in cases where the electric wire is bent and where the electric wire is not bent.

As shown in FIG. 1(*a*), a press-connecting terminal 1 to which a covered electric wire 30 is press-connected is U-shaped in side view and has slot-like press-connecting blades 2 on both sides thereof. Further, one end side of a base plate portion 3 between the press-connecting blades 2, 2 of the press-connecting terminal 1 is bent downward at a right angle to form a positive tab portion (fixed portion) 4. The positive tab portion 4 is mounted on a fitting mount 5 comprising a base, a connector and the like.

Figure 5A:
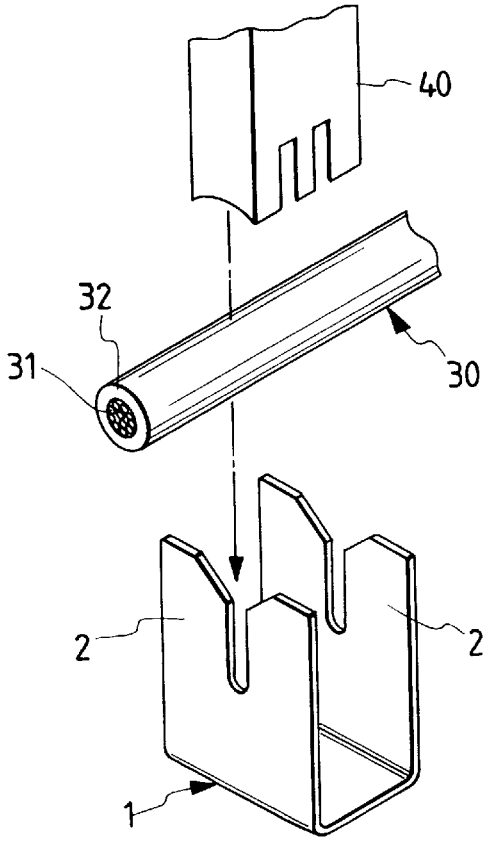
FIG. 5(a) PRIOR ART
FIG. 5(*a*) is a perspective view of a conventional example showing a condition in which an electric wire is not yet press-connected to a press-connecting terminal by means of a press-connecting jig.
Figure 5B:
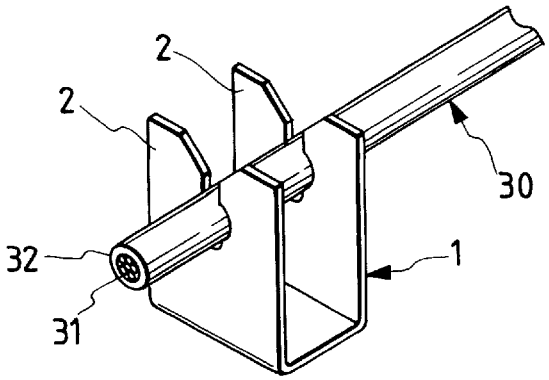
FIG. 5(b) PRIOR ART

As shown in FIGS. 1(*a*) and 1(*b*), the covered electric wire 30 is press-connected by the press-connecting jig 40 shown in FIG. 5(*a*) to the press-connecting blades 2 of the press-connecting terminal 1. More specifically, the press-connecting jig 40 is used to press-fit an insulating cover 32 of the covered electric wire 30 in between the press-connecting blades 2, 2 of the press-connecting terminal 1 and when the insulating cover 32 of the covered electric wire 30 is ripped off by each press-connecting blade 2, a conductor 31 of the covered electric wire 30 is press-connected to each press-connecting blade 2. In this condition, both sides of the covered electric wire 30 press-connected to the press-connecting blades 2, 2 of the press-connecting terminal 1 are respectively bent downward (in the electric-wire press-connecting direction, that is, in the direction of an arrow C in FIG. 1(*b*)). The covered electric wire 30 having bent portions 30*a* and 30*b* is bent toward the fitting mount 5 and also held by a pair of electric-wire holding members 6 and 7 of the fitting mount 5.

Figure 4:
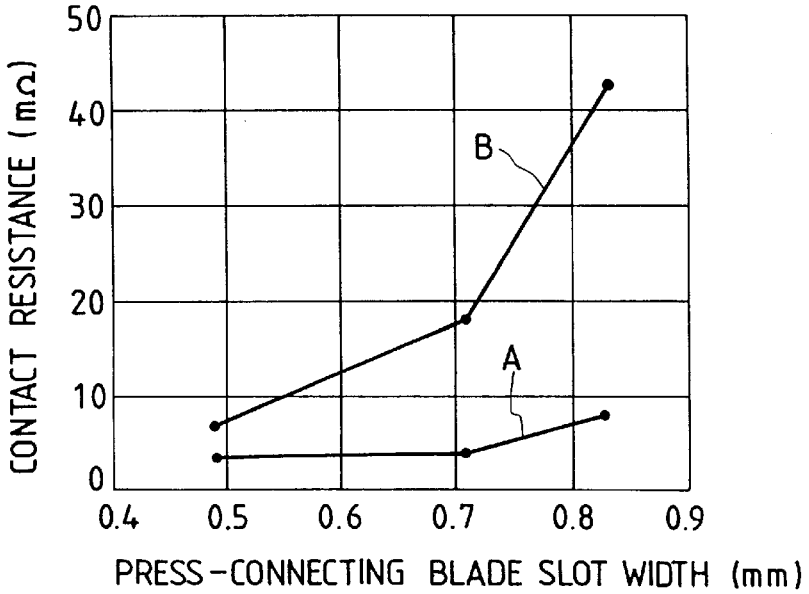
FIG. 4 is a graph showing comparative measured values in cases where the electric wire is bent and where the electric wire is not bent.

Thus, the covered electric wire 30 is press-connected to the press-connecting blades 2, 2 of the press-connecting terminal 1 before being bent downward with the press-connecting blades 2, 2 of the press-connecting terminal 1 as boundaries in order to apply tension in the direction of press-connecting blades 2, 2 of the press-connecting terminal 1 at all times, so that the press-connected condition of the electric wire 30 and the press-connecting blades 2, 2, of the press-connecting terminal 1 is steadily kept at all times and that the reliability of the electric connection between the press-connecting terminal 1 and the covered electric wire 30 is made improvable thereby; this is obvious from comparative measured values shown in FIG. 4 which refers to cases A and B where the electric wire is bent and where the electric wire is not bent with the press-connecting blades 2, 2 of the press-connecting terminal 1 as boundaries. In other words, the contact resistance in the case where the covered electric wire 30 is bent downward with the press-connecting blades 2, 2 of the press-connecting terminal 1 as boundaries (A shown in FIG. 4) becomes lower than in the case where the electric wire 30 is not bent (B shown in FIG. 4).

Figure 2A:
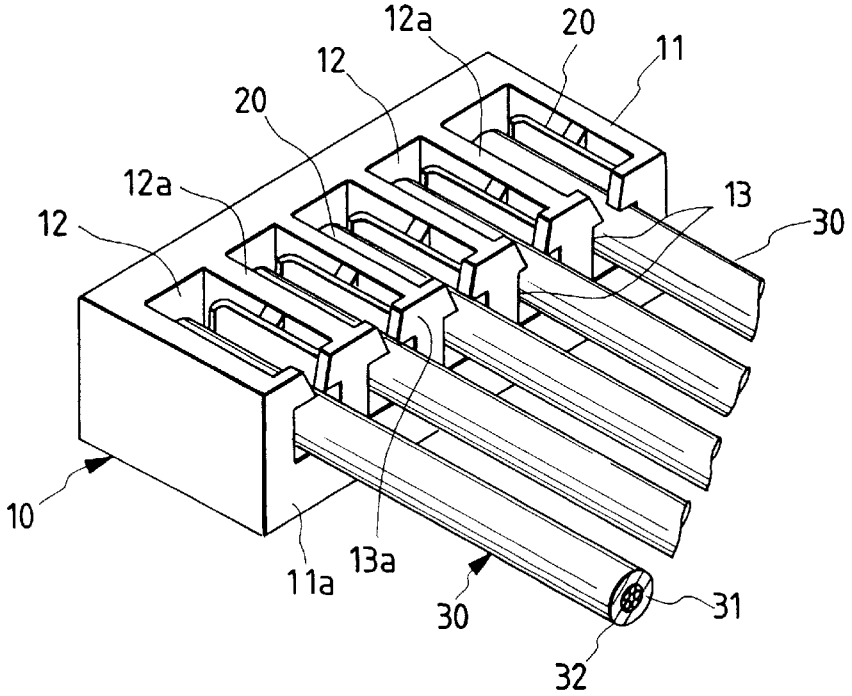
FIG. 2(*a*) is a perspective view showing another embodiment of the invention in which the above electric-wire connecting structure is applied to a connector.
Figure 2B:
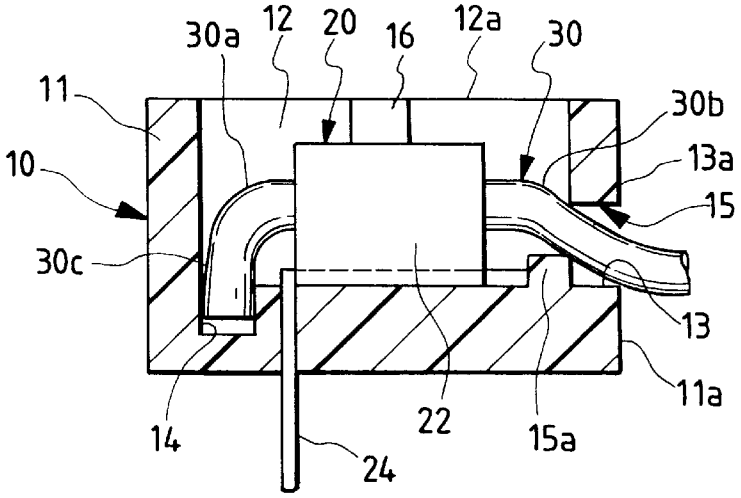
Figure 3:
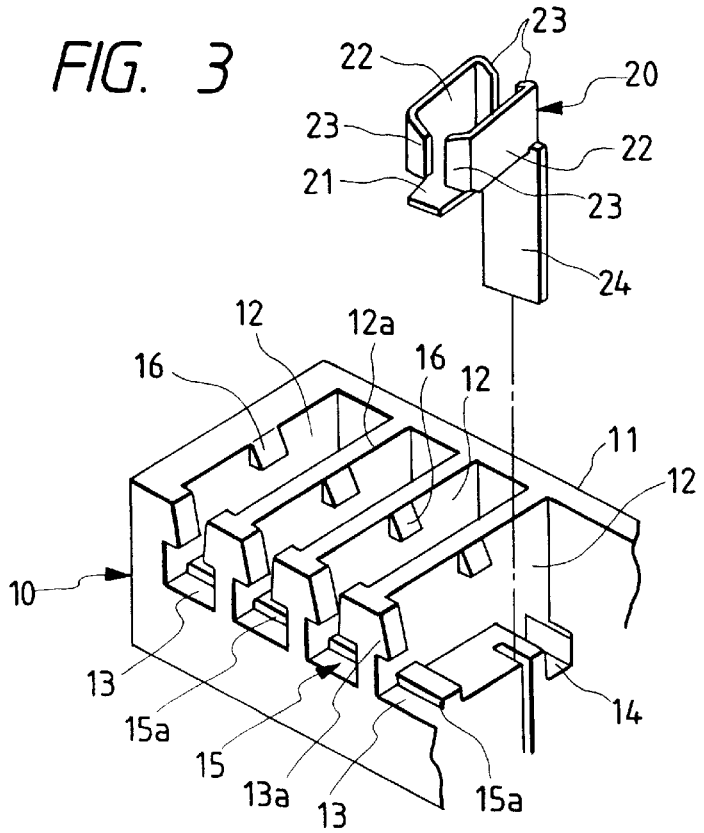
FIG. 3 is a partial perspective view showing a condition in which the connector is separated from a press-connecting terminal.

FIG. 2(*a*) is a perspective view showing another embodiment of the invention in which the aforesaid electric-wire connecting structure is applied to a connector; FIG. 2(*b*) is a sectional view of the principal part of the electric-wire connecting structure; and FIG. 3 is a partial perspective view showing a condition in which the connector is separated from a press-connecting terminal.

As shown in FIGS. 2(*a*), 2(*b*) and 3, a connector housing 11 of a press-connecting connector 10 as a fitting mount is in the form of a box made of synthetic resin, and its upper portion is partitioned into a plurality of terminal accommodating chambers 12 with partition walls 12*a*. Further, an electric-wire inserting port 13 is formed in a position opposite to each terminal accommodating chamber 12 of a front side wall (side wall) 11*a* of the connector housing 11. An upper portion 13*a* of each electric-wire inserting port 13 is cut in an inverted angled form so that a covered electric wire 30 can easily be inserted into each terminal accommodating chamber 12. A recessed portion (electric-wire holding means on one side) 14 for holding an end portion 30*c* of a bent portion 30*a* on one side of the bent covered electric wire 30 is formed on the side of a positive tab portion 24 of a press-connecting terminal 20, which will be described later, in the base of each terminal accommodating chamber 12 of the connector housing 11. Further, a protruded portion 15*a* is integrally formed in front of press-connecting blades 23 of the press-connecting terminal 20 on the base of each terminal accommodating chamber 12 of the connector housing 11. The protruded portion 15*a* and the upper portion 13*a* of the electric-wire inserting port 13 constitute the other electric-wire holding means 15 for holding the other bent portion 30*b* of the covered electric wire 30 in the bending direction. Moreover, a trigonal-prism-like terminal retaining protrusion 16 is integrally and projectingly formed on the upper center of the partition wall 12*a* of each terminal accommodating chamber 12 of the connector housing 11.

As shown in FIGS. 2(*a*), 2(*b*) and 3, the press-connecting terminal 20 accommodated in each terminal accommodating chamber 12 of the connector housing 11 has a pair of press-connecting blades 23, 23 on the longitudinal side of a pair of side walls 22, 22 projecting from the respective sides of a base plate portion 21. Further, the rear end side of the base plate portion 21 of each press-connecting terminal 20 forms a positive tab portion (fixed portion) 24 which is bent downward at a right angle. Each press-connecting terminal 20 is molded by insert molding integrally with the connector housing 11 and as shown in FIG. 2(*b*), the positive tab portion 24 of each press-connecting terminal 20 is passed through the base of each terminal accommodating chamber 12 of the connector housing 11 and projected outward from the base of the connector housing 11.

As shown in FIG. 2(*a*), a conductor 31 and an insulating cover 32 covering the conductor 31 constitute the covered electric wire 30. The covered electric wire 30 is press-connected to the pair of press-connecting blades 23, 23 and then both ends of the covered electric wire are bent downward (in the electric-wire press-connecting direction) by predetermined means with the press-connecting blades 23, 23 as boundaries. The covered electric wire 30 having the bent portions 30*a* and 30*b* are held by the electric-wire holding means 14 and 15 provided in each terminal accommodating chamber 12 of the connector housing 11.

In the electric-wire connecting structure of this embodiment, as shown in FIG. 2(*b*), the covered electric wire 30 is press-connected to the pair of press-connecting blades 23, 23 of the press-connecting terminal 20 accommodated in each terminal accommodating chamber 12 of the connector housing 11 and then curved toward the base of the terminal accommodating chamber 12 by bending both sides of the covered electric wire 30 downward (in the electric-wire press-connecting direction) with the press-connecting blades 23, 23 as boundaries. At this time, it is ensured that the end portion 30*c* on the one bent portion 30*a* of the covered electric wire 30 fitted into the recessed portion 14 is securely held and that the mid-portion on the other bent portion 30*b* of the covered electric wire 30 is securely held between the protruded portion 15*a* on the base of the terminal accommodating chamber 12 and the upper portion 13*a* of the electric-wire inserting port 13.

Since the conductor 31 of the covered electric wire 30 is brought into contact with the pair of press-connecting blades 23, 23 of the press-connecting terminal 20 while tension is applied thereto at all times, the conductor 31 of the covered electric wire 30 is prevented from slipping off the press-connecting blades 23, 23 of the press-connecting terminal 20 even when an external load such as vibration is applied to the press-connecting terminal 20, so that the electrically connected condition of the covered electric wire 30 and the press-connecting blades 23, 23 of the press-connecting terminal 20 is steadily kept at all times.

Although it has been so arranged in each embodiment of the invention as to hold the covered electric wire bent with the press-connecting blades of the press-connecting terminal as boundaries by means of the electric-wire holding means provided on the connector housing side, the electric-wire holding means may be provided on the side of not only the connector housing but also the press-connecting terminal.

As described above, according to the present invention, the electric wire is prevented from slipping off the press-connecting blades of the press-connecting terminal due to vibration and the like since the electric wire is kept urged toward the press-connecting blade side of the press-connecting terminal, so that the reliability of electrical contact condition of the press-connected electric wire with the press-connecting blades of the press-connecting terminal is improved.

What is claimed is:

1. An electric-wire connecting structure comprising:

a press-connecting terminal having press-connecting blades, each having a substantially U-shape including a base portion and a pair of opposing legs; and an electric wire to be press-connected to the press-connecting blades of said press-connecting terminal by pressing said wire in a press-connecting direction downwardly toward said base portion, wherein said electric wire press-connected to the press-connecting blades of said press-connecting terminal is bent on both opposite sides of said press-connecting terminal in said electric-wire press-connecting direction with the press-connecting blades as boundaries.

2. The electric-wire connecting structure according to claim 1, wherein said press-connecting terminal is accommodated in a terminal accommodating chamber of a connector housing, and electric-wire holding means for holding said electric wire in a direction in which said electric wire is bent is provided in the terminal accommodating chamber.

3. The electric-wire connecting structure according to claim 2, wherein said electric-wire holding means includes a recessed portion formed in a base of the terminal accommodating chamber in which an end of said electric wire is received.

4. The electric-wire connecting structure according to claim 2, wherein said electric-wire holding means includes an electric-wire inserting port formed in a side wall of the terminal accommodating chamber, and a protruded portion formed on a base of the terminal accommodating chamber.

* * * * *